US005969274A

United States Patent [19]

Johnson

[11] Patent Number: 5,969,274

[45] Date of Patent: Oct. 19, 1999

[54] ALTERNATE METHOD OF SENSING PAPER ENTRY

[75] Inventor: Steven M. Johnson, Eagle, Id.

[73] Assignee: Hewlett-Packard Company, Palo Alto, Calif.

[21] Appl. No.: 08/804,994

[22] Filed: Feb. 25, 1997

[51] Int. Cl.[6] ..... B65H 43/00

[52] U.S. Cl. ..... 73/865.9; 271/3.17

[58] Field of Search ..... 73/865.9, 509, 73/510, 511; 271/3.17, 3.15

[56] References Cited

U.S. PATENT DOCUMENTS

| | | | |
|---|---|---|---|
| Re. 27,442 | 7/1972 | Weir | 38/143 |
| 3,536,272 | 10/1970 | Ueyama | 242/413.9 |
| 4,717,141 | 1/1988 | Germona | 271/183 |
| 4,877,230 | 10/1989 | Winkler et al. | 271/3.15 |
| 5,203,551 | 4/1993 | Lowell et al. | 270/59 |
| 5,366,217 | 11/1994 | Tokuna et al. | 271/182 X |
| 5,441,214 | 8/1995 | Kushihoshi et al. | 242/552 |
| 5,532,809 | 7/1996 | Hamonaka et al. | 271/3.15 X |
| 5,648,843 | 7/1997 | Eguchi | 271/3.17 X |

FOREIGN PATENT DOCUMENTS

| | | | |
|---|---|---|---|
| 60536 | 3/1989 | Japan . | |
| 288542 | 11/1989 | Japan | 271/3.15 |

OTHER PUBLICATIONS

*Patent Abstracts of Japan* "Slippage Measuring Apparatus" Abs grp p. 708 vol. 12, No. 178. Abs pub date May 26, 1988 (62–288577).

*Patent Abstracts of Japan* "Jam Detector Device" Yuji Eguchi Abs Grp M837 vol. 13, No. 257 Abs pub date Jun. 14, 1989 (01–60536).

*Patent Abstracts of Japan* "Slip Processing Device" Abs Grp M0962 vol. 14, No. 186 Abs pub date Apr. 16, 1990 (02–34372).

*Patent Abstracts of Japan* "Detecting Method of Abnormal Rotation of Printing Roll" Abs Grp, M1202, vol. 16, No. 26 Abs pub date Jan. 22, 1992 (03–239547).

*Primary Examiner*—Thomas P. Noland

[57] ABSTRACT

A system and method detect the location of a workpiece as it passes from a feeding mechanism to a receiving pair of rollers. The system generally consists of a feeding mechanism having a pair of feeding rollers, a pair of receiving rollers, a motor control system for applying a fixed torque to the receiving rollers causing the receiving rollers to rotate, and a tachometer for monitoring the revolution speed of the receiving rollers. The motor control system for revolving the rollers consists of a motor, motor controller and a microprocessor to program the motor speed or torque. A decrease in the revolution speed of the receiving rollers indicates the workpiece has been received by the receiving rollers. An increase in the revolution speed of the receiving rollers subsequent to the decrease in speed indicates the workpiece has been released from the feeding mechanism.

18 Claims, 1 Drawing Sheet

ALTERNATE METHOD OF SENSING PAPER ENTRY

FIELD OF THE INVENTION

This invention relates in general to a system and method for detecting the location of a workpiece as it is passed from a feeding mechanism to receiving rollers, more specifically, to detecting the location of the workpiece by sensing the speed of the receiving rollers.

BACKGROUND OF THE INVENTION

The prior art method of sensing paper in a printer is to use mechanical flags in the paper path. Paper passing along the paper path causes the flags to move, triggering a signal. The signal indicates the presence of the paper. One drawback to the use of these flags occurs when the flags are used to monitor paper entering or exiting rollers. The mechanical flags must be located some distance away from the rollers so that neither the flags nor the rollers interfere with the other's operation. The flags therefore cannot be used to determine the precise time at which the paper enters or exits the rollers.

An inversion process is an example of when a more accurate determination of this time is important. The inversion process is used to discharge a printed page with the printed side down. Discharging pages with the printed side down allows a sequence of pages to be printed and discharged into a stack with the first page of the sequence being the bottom page of the stack.

Inverting a page must be performed quickly as another page may be following closely behind the first printed page. In order to take full advantage of the time allowed for inverting a page, it is desirable to start the inverting process as soon as possible. Providing a means for precisely detecting the exit time of a page from a roller allows the inverting process to begin as soon as the page leaves the rollers immediately preceding the inverter.

Accordingly, given the foregoing background relating to sensing paper entry and exit with respect to rollers, an object of the present invention is to provide a system and method for detecting more precisely when a workpiece is received by or released from a pair of rollers.

SUMMARY OF THE INVENTION

According to principles of the present invention in a preferred embodiment, a system and method provide a simple, cost effective and timely method of detecting the location of a workpiece, e.g., paper sheets, with respect to rollers used to process the workpiece. A fixed torque is applied to at least one receiving roller of a pair of receiving rollers causing the receiving roller to rotate. The fixed torque is set so that the peripheral speed of the receiving roller, when the workpiece is not between the pair of receiving rollers, is greater than the linear speed of the workpiece. The linear speed of the workpiece is determined by the speed of the feeding mechanism. The rotation speed of the at least one receiving roller is monitored. As the slower moving workpiece is received between the pair of receiving rollers, the peripheral speed (and the rotational speed) of the at least one receiving roller is slowed to the linear speed of the workpiece. As the workpiece is released from the feeding mechanism, the rotational speed of the at least one receiving roller increases. Thus, changes in the rotational speed of the receiving roller indicate the location of a workpiece with respect to a feeding mechanism and a pair of receiving rollers.

According to further principles of the present invention in a preferred embodiment, when no workpiece is between the pair of receiving rollers, the revolution speed, and consequently the peripheral speed, of the receiving rollers is fixed. The revolution speed of the receiving rollers is fixed such that the current required to maintain the fixed revolution speed without the workpiece is less than the current required to produce the fixed torque in the receiving rollers. As the workpiece is received by the receiving rollers, the current increases to maintain the fixed revolution speed. The current increases only up to the current required to produce the fixed torque. As the workpiece continues to be received by the workpiece, the peripheral speed of the receiving rollers decreases to the linear speed of the workpiece. As the workpiece is being released from the feeding mechanism, the decrease in resistance allows the revolution speed of the receiving rollers to increase. When the rollers again reach the revolution speed at which the receiving rollers are fixed with no workpiece, the current decreases to again maintain the fixed revolution speed.

Other objects, advantages, and capabilities of the present invention will become more apparent as the description proceeds.

DETAILED DESCRIPTION OF THE INVENTION

Figure 1:
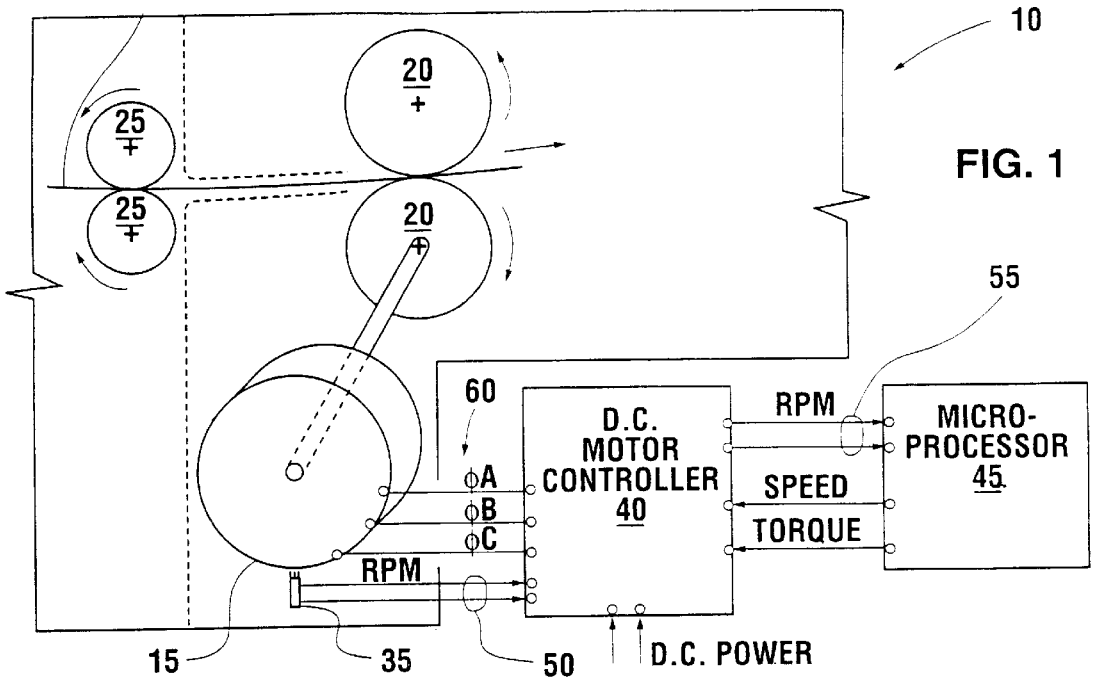
FIG. 1 is a schematic representation of the present invention using a dc brushless motor as a receiving roller drive.

FIG. 1 represents a preferred embodiment of the present invention system 10 as incorporated into a printer system. Dc motor 15 rotates receiving rollers 20 by applying a fixed torque to receiving rollers 20. Alternatively, only one of receiving rollers 20 is rotated by dc motor 15. Feeding rollers 25 are rotated at a constant speed by a separate drive motor (not shown). Paper 30 is fed from feeding rollers 25 to receiving rollers 20. Feeding rollers 25 are spaced from receiving rollers 20 so that paper 30 is received by receiving rollers 20 before paper 30 is released from feeding rollers 25.

Alternatively, feeding rollers 25 are any feeding mechanism which will allow paper 30 to be received by receiving rollers 20 before paper 30 is released from the feeding mechanism.

Tachometer means 35 monitors the revolution speed of dc motor 15. The revolution speed of receiving rollers 20 is determined from the revolution speed of dc motor 15. Alternatively, tachometer means 35 monitors the revolution speed of receiving rollers 20. The peripheral speed of receiving rollers 20 is determined from the size and revolution speed of receiving rollers 20. Tachometer means 35 is any means by which the revolution speed of dc motor 15 or receiving rollers 20 is determined. Examples of tachometer means 35 include a tachometer and back EMF measurement.

In a preferred embodiment, dc motor 15 is a brushless dc motor. Brushless dc motors have a stationary armature and a rotating field structure. Permanent magnets provide magnetic flux for the field. Dc current to the armature is commutated with transistors rather than with the brushes and commutator bars of conventional dc motors. The transistors are located within dc motor controller 40. Armatures of dc brushless motors typically contain 2 to 6 coils, whereas conventional dc motor armatures have from 10 to 50. Brushless motors have fewer coils because either two or four transistors are required to commutate each motor coil. This arrangement becomes increasingly costly and inefficient as the number of windings increases.

The transistors controlling each winding of a dc brushless motor are turned on and off at specific rotor angles. The transistors provide current pulses to the armature windings that are similar to those provided by a commutator. The switching sequence is arranged to produce a rotating magnetic flux in the air gap that stays at a fixed angle to the flux produced by the permanent magnets on the rotor. Torque produced by the brushless dc motor is directly proportional to armature current, which in turn is controlled by the transistors in dc motor controller 40.

In a preferred embodiment, the rotational speed of dc motor 15 or receiving rollers 20 is sensed by tachometer means 35 and transmitted back to microprocessor 45 via dc motor controller 40 at conductors 50 and 55. The torque of motor 15 is controlled by dc motor controller 40 which in turn is directed by microprocessor 45. Microprocessor 45 directs the torque by requesting a specific current from dc motor controller 40 to dc motor 15. Dc motor controller 40 controls the torque by providing a specific output power 60 to the rotating field of dc motor 15.

In a further preferred embodiment of the present invention, when no workpiece is between the pair of receiving rollers, the revolution speed, and consequently the peripheral speed, of the receiving rollers is fixed. The revolution speed of the receiving rollers is fixed such that the current required to maintain the fixed revolution speed without the workpiece is less than the current required to produce the fixed torque in the receiving rollers. As the workpiece is received by the receiving rollers, the current increases to maintain the fixed revolution speed. The current increases only up to the current required to produce the fixed torque. As the workpiece continues to be received by the workpiece, the peripheral speed of the receiving rollers decreases to the linear speed of the workpiece. As the workpiece is being released from the feeding mechanism, the decrease in resistance allows the revolution speed of the receiving rollers to increase. When the rollers again reach the revolution speed at which the receiving rollers are fixed with no workpiece, the current decreases to again maintain the fixed revolution speed.

Figure 2:
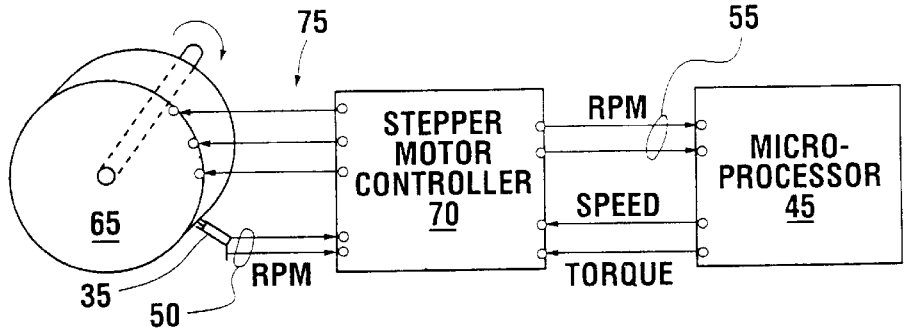
FIG. 2 is a partial schematic diagram of the present invention using a stepper motor drive.

FIG. 2, illustrates an alternate embodiment of the present invention where dc motor 15 and dc motor controller 40 are replaced by stepper motor 65 and stepper motor controller 70. The primary characteristic of a stepper motor is its ability to rotate a prescribed small angle (step) in response to each control pulse applied to its windings. Below about 200 pulses per second, the motor rotates in discrete steps in synchrony with the pulses; at higher frequencies, the motor skews without stopping between pulses. Although motors are available for step angles of 90 to 180°, the common step is 1.8°. Stepper motors are categorized as permanent-magnet (PM) rotor, variable reluctance (VR), or hybrid (PM-VR). The rotor of the PM aligns itself with the energized stator poles and the rotor turns until the poles are aligned at each step. In the present application, control pulse or frequency can be utilized between 0 and 1000 Hz to control torque. Stepper motor 65 and stepper motor controller 70 include an encoder and synchronizer to simulate the current-torque response of a brushless dc motor. In a preferred embodiment, the torque of stepper motor 65 is controlled by stepper motor controller 70 which in turn is directed by microprocessor 45. Torque is controlled by the output frequency at 75 to stepper motor 65.

Figure 3:
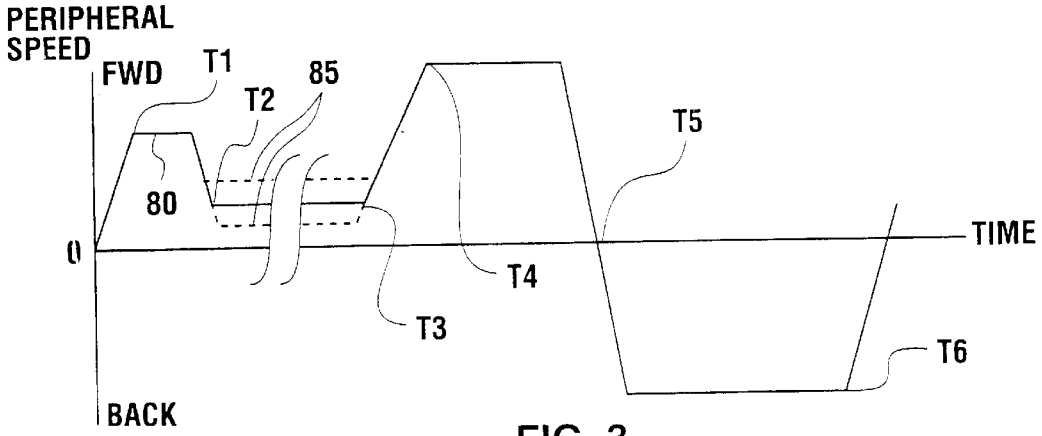
FIG. 3 is a plot of receiving roller peripheral speed as a function of time.

FIG. 3 represents a graph of the peripheral speed of receiving rollers 20 versus time. The fixed torque applied to receiving rollers 20 is selected so that the resulting peripheral speed 80 of receiving rollers 20 is greater than peripheral speed 85 of feeding rollers 25, when no paper 30 is in system 10. A typical peripheral speed 80 of receiving rollers 20 is 300 mm/sec.

Paper 30 is fed from feeding rollers 25 and is received by receiving rollers 20 at time T1. As paper 30 is received by receiving rollers 20, the peripheral speed of receiving rollers 20 drops at time T2 to the peripheral speed 85 of feeding rollers 25. The peripheral speed of receiving rollers 20 drops because paper 30 moves at the constant speed 85 of feeding rollers 25. The decrease in the peripheral speed of receiving rollers 20 indicates that paper 30 has been received by receiving rollers 20. Preferably, tachometer means 35 transmits a signal indicative of the revolution speed of receiving rollers 20 to microprocessor 45. Microprocessor 45 analyzes the signal and detects the change in speed of receiving rollers 20.

As paper 30 remains in contact with both receiving rollers 20 and feeding roller 25, the peripheral speed of receiving rollers 20 remains the same as the peripheral speed 85 of feeding rollers 25. In a preferred embodiment of the present invention the torque applied to receiving rollers 20 is reduced after time T2 in order to prevent paper slipping and tearing. In the preferred embodiment, microprocessor 45 receives a signal from tachometer means 35 indicative of the rotational speed of receiving rollers 20. When a change in the rotational speed is indicated, microprocessor 45 instructs motor controller 40 to reduce the torque applied to receiving rollers 20.

At time T3, the trailing edge of paper 30 is released from feeding rollers 25. Since feeding rollers 25 no longer limit the speed of paper 30, the peripheral speed of receiving rollers 20 increases due to the fixed torque applied to receiving rollers 20. The increase in the peripheral speed of receiving rollers 20 indicates paper 30 has been released from feeding rollers 25.

One use for the present invention is in an inverting process wherein paper 30 is inverted as it exits a printer so that it exits with the printed side facing down. FIG. 3 further illustrates a typical peripheral speed versus time plot for an example where receiving rollers 20 are part of an inverting apparatus. The increase in speed at time T3 triggers microprocessor 45 to accelerate receiving rollers 20 to nominally 640 mm/sec as shown at T4 and at the same time actuate the inverting process that is completed between times T4 and T6. The process requires reversal of receiving rollers 20 at T5 to effect the paper inversion. This process must be achieved quickly as another page of paper may follow the first page of paper 30. To achieve the inverting process quickly, the peripheral speed of receiving rollers 20 is increased as soon as possible after paper 30 is released from feeding rollers 25. The present invention detects the release of paper 30 from feeding rollers 25 as feeding rollers 25 are releasing paper 30.

Additionally, the length of workpiece 30 is determined from a measured time between points T1 and T3. Multiplying the measured time by the linear speed of workpiece 30 produces the workpiece length. The workpiece length is useful in determining errors in a conveying system and for computing a speed profile for the inverting process. A speed profile is used to determine the speed at which a sheet of paper must be inverted in order to complete the inverting process before the next sheet of paper appears.

Although the present invention has been described with reference to a printer system, the present invention is alternatively implemented in any system where a workpiece is received by receiving rollers before being released from a feeding mechanism. Furthermore, paper 30 is any workpiece such as cardboard, metal, string, or other linear product that can be progressed by rollers.

What is claimed is:

1. A system for detecting progress of a workpiece, the system comprising:

(a) a receiving pair of rollers, each roller of said receiving pair of rollers facing the other roller of said receiving pair of rollers so that the workpiece is receivable between the rollers of said receiving pair of rollers;

(b) means for revolving at least one roller of said receiving pair of rollers by applying a first fixed torque to the at least one roller of the receiving pair of rollers, so that a peripheral speed of the at least one roller is greater than a linear speed of the workpiece;

(c) means for detecting a change in peripheral speed of the at least one roller of said receiving pair of rollers;

(d) means for replacing the first fixed torque applied to the at least one roller of said receiving pair of rollers with a second fixed torque when a decrease in peripheral speed of the at least one roller of said receiving pair of rollers is detected; and, wherein a decrease in the peripheral speed of the at least one roller of said receiving pair of rollers indicates said receiving pair of rollers has received the workpiece.

2. The system of claim 1 further including a feeding mechanism for feeding the workpiece to the receiving pair of rollers and wherein an increase in the peripheral speed of the at least one roller of said receiving pair of rollers indicates the workpiece has been released from said feeding mechanism.

3. The system of claim 1 wherein said means for revolving said receiving pair of rollers includes a dc motor.

4. The system of claim 1 further including means for adjusting the first torque to maintain the peripheral speed of the at least one roller of the receiving pair of rollers without exceeding an upper torque limit wherein the peripheral speed of the at least one roller of the receiving pair of rollers is not maintained when an amount of torque necessary to maintain the peripheral speed exceeds the upper torque limit.

5. The system of claim 1 wherein said means for detecting includes:

(a) tachometer means for sensing a revolution speed of the at least one roller of said receiving pair of rollers, said tachometer means providing an output signal indicative of the revolution speed of the at least one roller of said receiving pair of rollers;

(b) a microprocessor for receiving said output signal and determining from said output signal when a change in the peripheral speed of the at least one receiving roller has occurred; and, (c) means for providing said output signal from said tachometer means to said microprocessor.

6. A method for detecting progress of a workpiece, the method comprising:

(a) providing a receiving pair of rollers, each roller of said receiving pair of rollers facing the other roller of said receiving pair of rollers so that the workpiece is receivable between the rollers of said receiving pair of rollers;

(b) revolving at least one roller of the receiving pair of rollers by applying a first torque to the at least one roller of the receiving pair of rollers, so that a peripheral speed of the at least one roller of the receiving pair of rollers is greater than a linear speed of the workpiece;

(c) detecting a change in the peripheral speed of the at least one roller of said pair of rollers;

(d) replacing the first fixed torque applied to the at least one roller of said receiving pair of rollers with a second fixed torque when a decrease in peripheral speed of the at least one roller of said receiving pair of rollers is detected; and, wherein a decrease in the peripheral speed of the at least one roller of the receiving pair of rollers indicates the receiving pair of rollers has received the workpiece.

7. The method of claim 6 further including feeding the workpiece to said receiving pair of rollers from a feeding mechanism and wherein an increase in the speed of the at least one roller of said receiving pair of rollers indicates the workpiece has been released from said feeding mechanism.

8. The method of claim 6 wherein said revolving is performed by a dc motor.

9. The method of claim 6 further including adjusting the first torque to maintain the peripheral speed of the at least one roller of the receiving pair of rollers without exceeding an upper torque limit wherein the peripheral speed of the at least one roller of the receiving pair of rollers is not maintained when an amount of torque necessary to maintain the peripheral speed exceeds the upper torque limit.

10. The method of claim 6 wherein said detecting includes:

(a) sensing a revolution speed of the at least one roller of said receiving pair of rollers, (b) providing an output signal indicative of the revolution speed of the at least one roller of said receiving pair of rollers;

(c) receiving said output signal; and, (d) determining from said output signal when a change in the peripheral speed of the at least one receiving roller has occurred.

11. A system for detecting progress of a workpiece, the system comprising:

(a) a receiving pair of rollers, each roller of said receiving pair of rollers facing the other roller of said receiving pair of rollers so that the workpiece is receivable between the rollers of said receiving pair of rollers;

(b) means for revolving at least one roller of said receiving pair of rollers by applying a first fixed torque to the at least one roller of the receiving pair of rollers, so that a peripheral speed of the at least one roller is greater than a linear speed of the workpiece;

(c) means for detecting a change in peripheral speed of the at least one roller of said receiving pair of rollers;

(d) means for adjusting the first torque to maintain the peripheral speed of the at least one roller of the receiving pair of rollers without exceeding an upper torque limit wherein the peripheral speed of the at least one roller of the receiving pair of rollers is not maintained when an amount of torque necessary to maintain the peripheral speed exceeds the upper torque limit; and, wherein a decrease in the peripheral speed of the at least one roller of said receiving pair of rollers indicates said receiving pair of rollers has received the workpiece.

12. The system of claim 11 further including a feeding mechanism for feeding the workpiece to the receiving pair of rollers and wherein an increase in the peripheral speed of the at least one roller of said receiving pair of rollers indicates the workpiece has been released from said feeding mechanism.

13. The system of claim 11 wherein said means for revolving said receiving pair of rollers includes a dc motor.

14. The system of claim 11 wherein said means for detecting includes:

(a) tachometer means for sensing a revolution speed of the at least one roller of said receiving pair of rollers, said tachometer means providing an output signal indicative of the revolution speed of the at least one roller of said receiving pair of rollers;

(b) a microprocessor for receiving said output signal and determining from said output signal when a change in the peripheral speed of the at least one receiving roller has occurred; and, (c) means for providing said output signal from said tachometer means to said microprocessor.

15. A method for detecting progress of a workpiece, the method comprising:

(a) providing a receiving pair of rollers, each roller of said receiving pair of rollers facing the other roller of said receiving pair of rollers so that the workpiece is receivable between the rollers of said receiving pair of rollers;

(b) revolving at least one roller of the receiving pair of rollers by applying a first torque to the at least one roller of the receiving pair of rollers, so that a peripheral speed of the at least one roller of the receiving pair of rollers is greater than a linear speed of the workpiece;

(c) detecting a change in the peripheral speed of the at least one roller of said pair of rollers;

(d) adjusting the first torque to maintain the peripheral speed of the at least one roller of the receiving pair of rollers without exceeding an upper torque limit wherein the peripheral speed of the at least one roller of the receiving pair of rollers is not maintained when an amount of torque necessary to maintain the peripheral speed exceeds the upper torque limit; and, wherein a decrease in the peripheral speed of the at least one roller of the receiving pair of rollers indicates the receiving pair of rollers has received the workpiece.

16. The method of claim 15 further including feeding the workpiece to said receiving pair of rollers from a feeding mechanism and wherein an increase in the speed of the at least one roller of said receiving pair of rollers indicates the workpiece has been released from said feeding mechanism.

17. The method of claim 15 wherein said revolving is performed by a dc motor.

18. The method of claim 15 wherein said detecting includes:

(a) sensing a revolution speed of the at least one roller of said receiving pair of rollers, (b) providing an output signal indicative of the revolution speed of the at least one roller of said receiving pair of rollers;

(c) receiving said output signal; and, (d) determining from said output signal when a change in the peripheral speed of the at least one receiving roller has occurred.

* * * * *